US012571231B2

(12) United States Patent
Dong et al.

(10) Patent No.: US 12,571,231 B2
(45) Date of Patent: Mar. 10, 2026

(54) OUTDOOR TENT WITH A MODULAR BASE

(71) Applicant: HANGZHOU YIXIANG TECHNOLOGY RESEARCH AND DEVELOPMENT CO., LTD., Hangzhou (CN)

(72) Inventors: Baichen Dong, Hangzhou (CN); Yulin Ye, Hangzhou (CN); Jianing Zhu, Hangzhou (CN); Chao Gu, Hangzhou (CN); Bailin Xu, Hangzhou (CN)

(73) Assignee: HANGZHOU YIXIANG TECHNOLOGY RESEARCH AND DEVELOPMENT CO., LTD., Hangzhou (CN)

( * ) Notice: Subject to any disclaimer, the term of this patent is extended or adjusted under 35 U.S.C. 154(b) by 279 days.

(21) Appl. No.: 18/452,521

(22) Filed: Aug. 19, 2023

(65) Prior Publication Data

US 2024/0102309 A1 Mar. 28, 2024

(30) Foreign Application Priority Data

Sep. 26, 2022 (CN) ..... 202211175767.9
Oct. 19, 2022 (CN) ..... 202211280857.4

(51) Int. Cl.
*E04H 15/56* (2006.01)
*E04H 15/02* (2006.01)
*E04H 15/34* (2006.01)

(52) U.S. Cl.
CPC ..... *E04H 15/56* (2013.01); *E04H 15/02* (2013.01); *E04H 15/34* (2013.01)

(58) Field of Classification Search
CPC ..... E04H 15/008; E04H 15/56
See application file for complete search history.

(56) References Cited

U.S. PATENT DOCUMENTS 2,883,713 A * 4/1959 Zug ..... E04B 1/3445 52/264
3,434,253 A * 3/1969 Hatcher ..... E04B 1/3445 D25/33
5,341,588 A * 8/1994 Lizotte ..... A01M 31/02 135/901
5,493,818 A * 2/1996 Wilson ..... E04B 1/3445 52/79.5

(Continued)

*Primary Examiner* — Noah Chandler Hawk
(74) *Attorney, Agent, or Firm* — HOWARD M COHN and Associates, LLC

(57) ABSTRACT

An outdoor tent with a modular base includes a main body and a base, the main body being detachably arranged on the base. The base includes a first module and several splicing modules, said several splicing modules being detachably connected to the periphery of the first module, and the first module can be folded to form a box structure, and said several splicing modules can be independently folded and stored in the box formed by the first module. When the base is in the storage state, the first module is folded to form a box structure in which items can be placed, and the second module, third module, fourth module and fifth module are folded and accommodated in the box formed by the first module, reducing space occupation during transportation, improving utilization rate of user space during transportation, and making it easy to carry and transport.

9 Claims, 19 Drawing Sheets

(56) References Cited

U.S. PATENT DOCUMENTS

| | | | | | |
|---|---|---|---|---|---|
| 5,622,198 | A * | 4/1997 | Elsinger | E04B 1/345 | 135/128 |
| 6,148,834 | A * | 11/2000 | Grooms, Sr. | E04H 15/56 | 403/387 |
| 7,774,919 | B2 * | 8/2010 | Bublitz | B65D 88/14 | 220/1.5 |
| 8,001,985 | B1 * | 8/2011 | Conner | E04H 15/56 | 135/96 |
| 8,806,810 | B2 * | 8/2014 | Barragan Olaya | E04B 1/3445 | 52/79.5 |
| 9,482,025 | B2 * | 11/2016 | Ludlow | E04H 15/56 | |
| 2014/0202510 | A1 * | 7/2014 | Tarter | E04H 15/02 | 135/96 |
| 2021/0032893 | A1 * | 2/2021 | Allbee | E04H 15/008 | |
| 2021/0214962 | A1 * | 7/2021 | Miller | E04H 15/20 | |

* cited by examiner

A

C

D

E

OUTDOOR TENT WITH A MODULAR BASE

REFERENCE TO RELATED APPLICATIONS

The present application claims the priorities of Chinese patent application No. 202211280857.4, filed on Oct. 19, 2022, and Chinese patent application No. 202211175767.9, filed on Sep. 26, 2022, the entire discloses of which are incorporated herein by reference.

FIELD OF THE DISCLOSURE

The present disclosure relates to the technical field of tents, in particular to an outdoor tent with a modular base.

BACKGROUND OF THE DISCLOSURE

Tent is a kind of camping and living prefabricated house that is easy to assemble and dismantle, and commonly used in various outdoor activities. The current existing tents have the following deficiencies: first, the tent structure is constructed through a frame, a tent cloth, and a base, and when a user travels, the base is generally carried in order to get a more comfortable experience; although area of the base could improve users' outdoor camping experience, it is not convenient to carry a large base; second, when a user carries electric wired electrical appliances, the chaotic layout of the electric wires leads to worse user experience.

SUMMARY OF THE DISCLOSURE

I. Technical Problem to be Solved

With respect to the deficiencies of the prior art, the present disclosure provides an outdoor tent with a modular base, which solves the problems raised in the Section "Background Art."

II. Technical Solutions

To achieve the above object, the present disclosure is achieved through the following technical solutions: an outdoor tent with a modular base, including a main body and a base, the main body being detachably arranged on the base, the base including a first module and several splicing modules, said several splicing modules being detachably connected to the periphery of the first module, wherein the first module can be folded to form a box structure, and said several splicing modules can be independently folded and stored in the box formed by the first module.

Preferably, the first module includes a first plate, a second plate and a third plate, the second plate and the third plate being respectively rotatably connected to both sides of the first plate, and when the first module is folded, the second plate and the third plate are used as side walls, and the first plate is used as a bottom wall.

Preferably, the first module further includes a fourth plate and a fifth plate, the fourth plate and the fifth plate being respectively rotatably connected to outer sides of the second plate and the third plate, and when the first module is stored, the fourth plate and the fifth plate are arranged side by side opposite to the first plate, and the first module forms a box with openings on two ends.

Preferably, the several splicing modules includes a second module, a third module, a fourth module and a fifth module, wherein when the base is unfolded, the second module and the third module are located on both sides of the first module in a vertical direction, and the fourth module and the fifth module are located on both sides of the first module in a horizontal direction.

Preferably, the second module includes a sixth plate and a seventh plate, the sixth plate being rotatably connected to the seventh plate, wherein when the second module is unfolded, the sixth plate and the seventh plate are arranged side by side; when the second module is folded, the sixth plate is located above the seventh plate, and the structure of the third module is consistent with that of the second module.

Preferably, the fourth module includes an eighth plate and a ninth plate, the eighth plate being rotatably connected to the ninth plate, wherein when the fourth module is unfolded, the eighth plate and the ninth plate are arranged side by side; when the fourth module is folded, the ninth plate is located above the eighth plate, and the structure of the fifth module is consistent with that of the fourth module.

Preferably, joints of the second module, the third module, the fourth module, the fifth module and the first module are all connected by reinforcing members.

Preferably, the first module is fixed with a first fixing plate, the fourth module is fixed with a second fixing plate, the second fixing plate being fixedly connected with the reinforcing member of the fourth module, the first fixing plate being detachably connected to the second fixing plate, and the first fixing plate being provided with an L-shaped groove matching with the second fixing plate.

Preferably, the base is further provided with a wiring channel and electric wires, the wiring channel communicating with an upper surface of the base, and the electric wires being arranged in the wiring channel.

Preferably, the wiring channel is located on the upper part of the base, the electric wires can extend from the wiring channel to the upper surface of the base, and the base is provided with electrical appliances or sockets, the electric wires extending out of the wiring channel being electrically connected to the electrical appliances or the sockets, and an electric wire receiving chamber is further provided in the base, in which an electric wire receiving post is provided in the electric wire receiving chamber, the electric wire receiving chamber being connected to the wiring channel, and the electric wires being arranged around the electric wire receiving post.

III. Advantageous Effect

The present disclosure provides an outdoor tent with a modular base, bringing about the following advantageous effects:

For the outdoor tent with a modular base, when the base is in the storage state, the first module is folded to form a box structure in which items can be placed, and the second module, third module, fourth module and fifth module are folded and accommodated in the box formed by the first module, reducing space occupation during transportation, improving utilization rate of user space during transportation, and making it easy to carry and transport.

Figure 1:
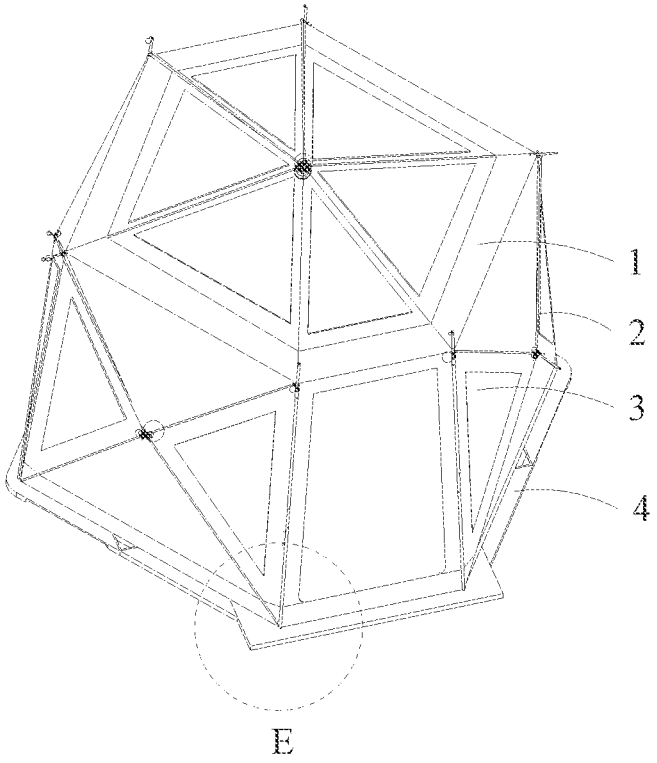
FIG. 1 is a schematic diagram of a three-dimensional assembly of a tent according to an embodiment of the present disclosure.

In the drawings: 1—main body; 2—frame; 3—wall; 35—metal ring piece; 4—base; 41—first module; 411—first plate; 412—second plate; 413—third plate 414—fourth plate; 415—fifth plate; 42—second module; 421—sixth plate; 422—seventh plate; 43—third module; 44—fourth module; 441—eighth plate; 442—ninth plate; 443—tenth plate; 444—eleventh plate; 45—fifth module; 46—reinforcing member; 461—extending portion; 4611—first extending portion; 4612 second extending portion; 4613—third extending portion; 4614 fourth extending portion; 4615—fifth extending portion; 4616—sixth extending portion; 4617—connector; 462—first fixing plate; 463—second fixing plate; 464—auxiliary member; 47—wiring channel; 471—electric wire receiving chamber; 472—electric wire receiving post; 51—electric wire; 52—power supply; 513—electric wire receiving device; 53—electrical appliance.

DETAILED DESCRIPTION OF THE EMBODIMENT(S) OF THE DISCLOSURE

Embodiments of the present disclosure provides an outdoor tent with a modular base. As shown in FIGS. 1-19, the tent includes a main body 1 and a base 4, and the main body 1 is installed on the base 4. The bottom of the main body 1 can wrap the base 4, that is, the area of the horizontal cross-section at the joint of the bottom of the main body 1 and the base 4 is greater than the area of the horizontal cross-section of the upper surface of the base 4, and the base 4 is located inside the main body 1. When it rains, rainwater can flow down along the surface of the main body 1 to facilitate water flowing out and reduce accumulation of rainwater on the base 4. It can be understood that the main body 1 can also be entirely located above the base 4, or at the joint between the main body 1 and the base 4, most of which are located above the base 4. That is, the area of the horizontal cross-section of the joint between the bottom of the main body 1 and the base 4 is smaller than the area of the horizontal cross-section of the upper surface of the base 4, and the bottom of the main body 1 is connected to the upper or inner surface of the base 4, which improves connection convenience of the base 4 of the main body 1.

Further referring to FIG. 1, the main body 1 includes a frame 2 and a wall 3, and the wall 3 is fixedly connected with the frame 2, that is, the frame 2 supports the wall 3. It can be understood that the frame 2 and the wall 3 can be fixed in a detachable way. For example, the frame 2 is detachably connected to those on the wall 3 such as sleeve, adhesive parts, magnetic attractors, clamping parts, etc., and the connection can also be achieved by the frame 2 clamping the wall 3. Other fixing methods can also be used, such as mutual sewing of the frame 2 and the wall 3, stitching of the frame 2 into the wall 3, or fixing of the frame 2 and the wall 3 through connectors. Of course, it is also possible to detachably connect part of the frame 2 to the wall 3, and fixedly connect part of the frame 2 to the wall 3.

The wall 3 can be made of soft materials, such as cloth, knitted, mesh-like or rubber materials, which is convenient for storage and finishing of the tent. The wall can also be made of hard materials, such as plastics, wood plates, etc. to enhance supporting strength of the whole tent. Of course, some materials could be hard supports, and some could be soft materials.

The wall 3 in the present disclosure can be composed of a whole piece of cloth. Under support of the frame 2, the wall 3 at least has a side wall 31 and a top wall 32. There is a plurality of side walls, for example, four side walls, six side walls, eight side walls, or more side walls, to form a tent. The side walls could be provided with a door wall. There may be one door wall, and may be more, such as two door walls, four door walls, etc. The door wall can be provided separately, for example, one of the side walls is used as the door wall, and the door wall is fixedly or detachably connected to other adjacent side walls. The door wall can also be formed on the side wall directly. For example, a large opening, vertical, triangular or oval, etc., could be formed on the side wall. Different setting methods can be selected upon demand of users. Each side wall can be a planar structure from the top wall to the direction of the base 4, such as a vertical plane, or an oblique plane; it can also be a concave-convex structure, such as concave-convex with a curved surface, or concave-convex with a central circle, or Pyramid concave-convex.

Figure 2:
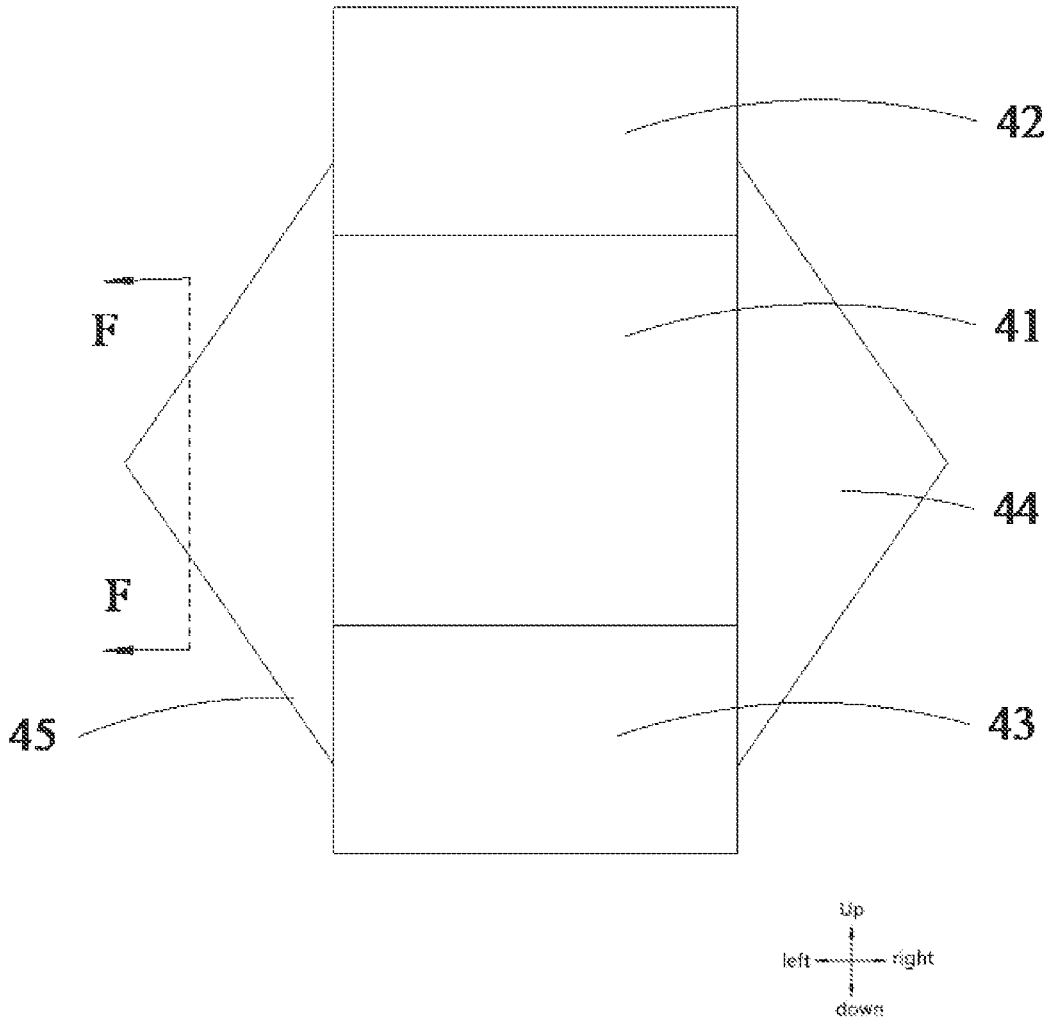
FIG. 2 is a schematic plan view of a base according to an embodiment of the present disclosure.

Further referring to FIG. 2, the base 4 is a modular structure, which is made of hard material. The base 4 includes at least two modules, such as 2, 4, 5 modules, etc. The modules or the module can be selectively folded, flipped, disassembled, etc. for storage and transportation. Specifically, the base 4 includes a first module 41, a second module 42, a third module 43, a fourth module 44, and a fifth module 45. The first module 41 is simultaneously connected with the second module 42, the third module 43, the fourth module 44 and the fifth module 45.

When the base 4 is opened or unfolded, in the direction marked in FIG. 2, the second module 42 and the third module 43 are on the upper and lower sides of the first module 41. For example, the second module 42 is located above the first module 41, the third module 43 is located below the first module 41, and within the range of process error, the second module 42 and the third module 43 are symmetrical about the horizontal axis of the base 4. The fourth module 44 and the fifth module 45 are located on left and right sides of the first module 41. For example, the fourth module 44 is located on the right side of the first module 41, the fifth module 45 is located on the left side of the first module 41, and within the range of process error, the fourth module 44 and the fifth module 45 are symmetrical with respect to the vertical axis of the base 4. The symmetrical configuration is convenient for installation and manufacture of the base 4 and shows users a kind of symmetrical beauty in use. The base 4 is approximately hexagonal, which increases use space of the base 4 for users. The total length of the base 4 in the left-right direction is between 3 meters and 4 meters, and the total length of the base 6 in the up-down direction is between 3 meters and 4 meters. The base 4 can at least meet the construction and use of the main body 1 of the tent for 4 people, which has a large space and improves user experience.

Figure 3:
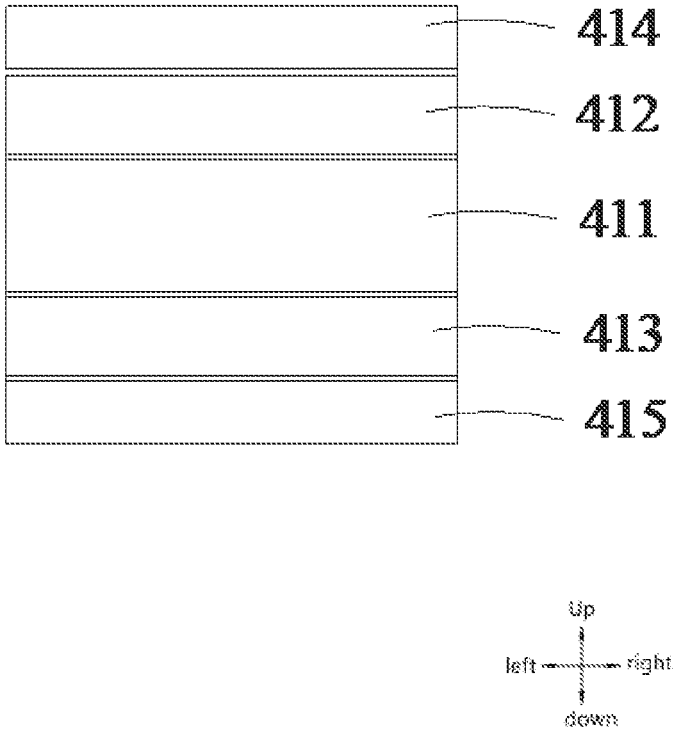
FIG. 3 is a schematic diagram of expansion of the first module according to an embodiment of the present disclosure.

Further referring to FIG. 3, the first module 41 includes a first plate 411, a second plate 412, a third plate 413, a fourth plate 414 and a fifth plate 415. The lengths of the first plate 411, the second plate 412, the third plate 413, the fourth plate 414 and the fifth plate 415 are all about 1.5 meters; the width of the first plate 411 is about 0.5 meters, the width of the second plate 412 and the third plate 413 is 0.3 meters, and the width of the fourth plate 414 and the fifth plate 415 is about 0.25 meters. Two ends in the width direction of the first plate 411 are respectively rotatably connected with the second plate 412 and the third plate 413, the other end of the second plate 412 is rotatably connected to the fourth plate 414, and the other end of the third plate 413 is rotatably connected to the fifth plate 415. That is, the first plate 411, the second plate 412, the third plate 413, the fourth plate 414 and the fifth plate 415 are arranged side by side. In the direction shown in FIG. 3, the second plate 412 is located above the first plate 411, the fourth plate 414 is located above the second plate 412, and the third plate 413 is located below the first plate 411, and the fifth plate 415 is located below the third plate 413.

Figure 8:
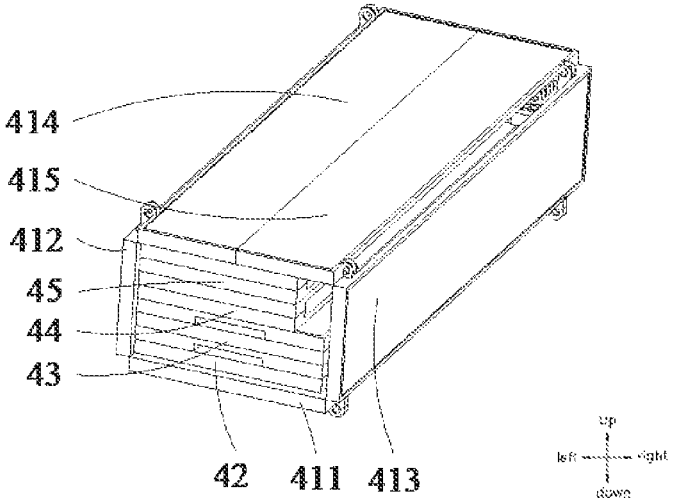
FIG. 8 is a schematic diagram of folding of the overall base according to an embodiment of the present disclosure.

Referring to FIG. 8, the plates of the first module 41 can be rotated relative to each other, so that the first module 41 forms a box with openings at both ends in the length direction. Specifically, the second plate 412 can rotate 90 degrees relative to the first plate 411, the third plate 413 can rotate 90 degrees relative to the first plate 411, the fourth plate 414 can rotate 90 degrees relative to the second plate 412, and the fifth plate 415 can rotate 90 degrees relative to the third plate 413. It can be understood that rotating 90 degrees is to realize the purpose of the first module 41 forming a box with openings at both ends. Of course, it can also be rotated by an angle between 80° and 100°, which also falls within the protection scope of the present disclosure as long as the first module 41 can form a box. After the first module 41 forms the box through the rotation of each plate, the first plate 411 forms a bottom wall of the box, the second plate 412 and the third plate 413 are arranged oppositely to form two side walls of the box, the fourth plate 414 and the fifth plate 415 are horizontally arranged side by side to form a top wall, and the fourth plate 414 and the fifth plates 415 are both opposite to the first plate 411. The first module 41 forming the box facilitates storage and transportation, and meanwhile the space formed therein can be used for placing items, which reduces the space occupation in the process of transportation and improves the space utilization rate for users during transportation.

Figure 4:
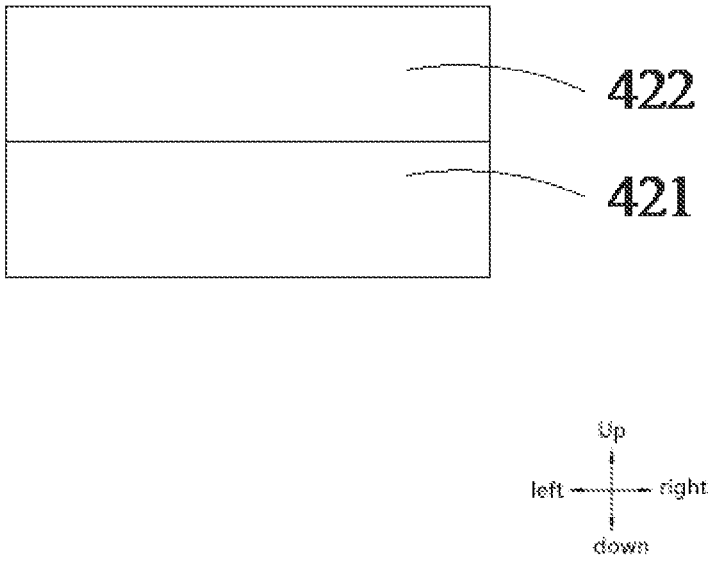
FIG. 4 is a schematic diagram of expansion of the second module according to an embodiment of the present disclosure.
Figure 6:
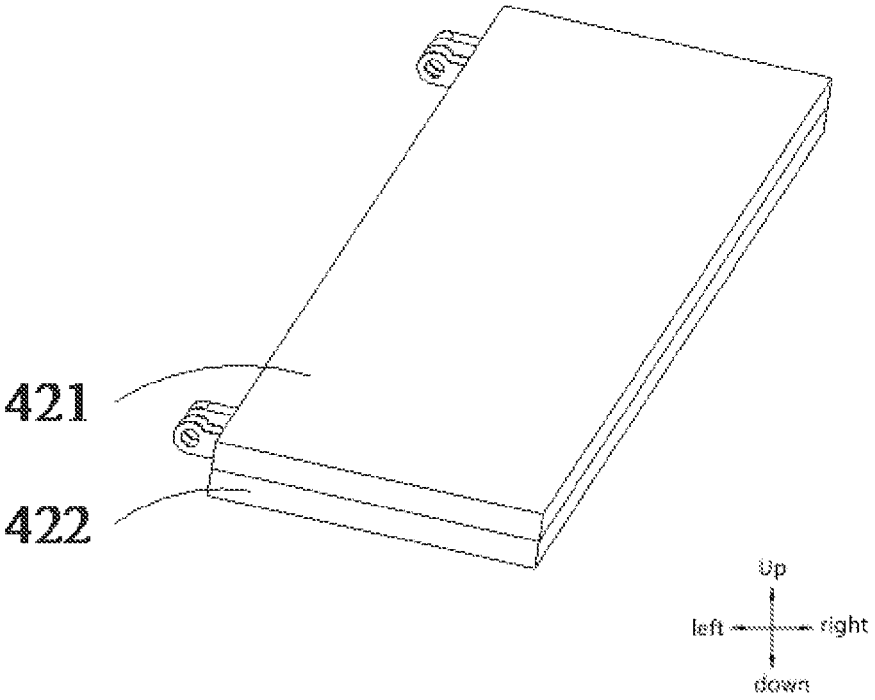
FIG. 6 is a schematic diagram of folding of the second module according to an embodiment of the present disclosure.

Referring to FIG. 4 and FIG. 6, both the second module 42 and the third module 43 are detachably connected to the first module 41. The second module 42 includes a sixth plate 421 and a seventh plate 422, which are the same in size and arranged side by side when unfolded. A rotation of 180 degrees is allowed between the sixth plate 421 and the seventh plate 422, so that the sixth plate 421 and the seventh plate 422 can be folded. The third module 43 is consistent with the second module. The third module 43 also has two consistent plates, and the two plates of the third module 43 can also be rotated 180 degrees to each other for folding. The second module 42 and the third module 43 after folded can be placed in the space inside the box formed by the first module 41, which is convenient for carrying and transportation. Specifically, when the second module 42 is unfolded, the sixth plate 421 is located below the seventh plate 422; when the second module 42 is folded, the sixth plate 421 is located above the seventh plate 422.

Figure 5:
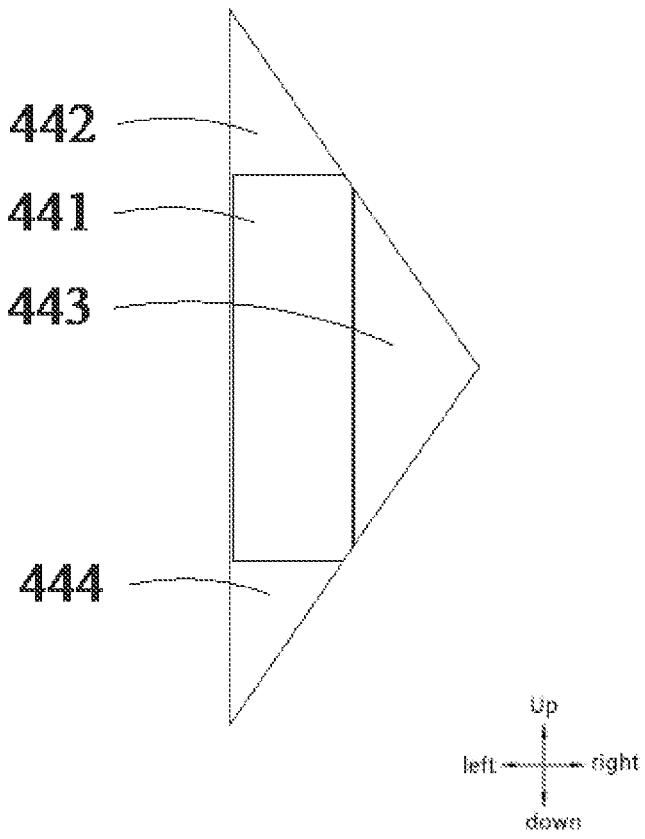
FIG. 5 is a schematic diagram of expansion of the fourth module according to an embodiment of the present disclosure.
Figure 7:
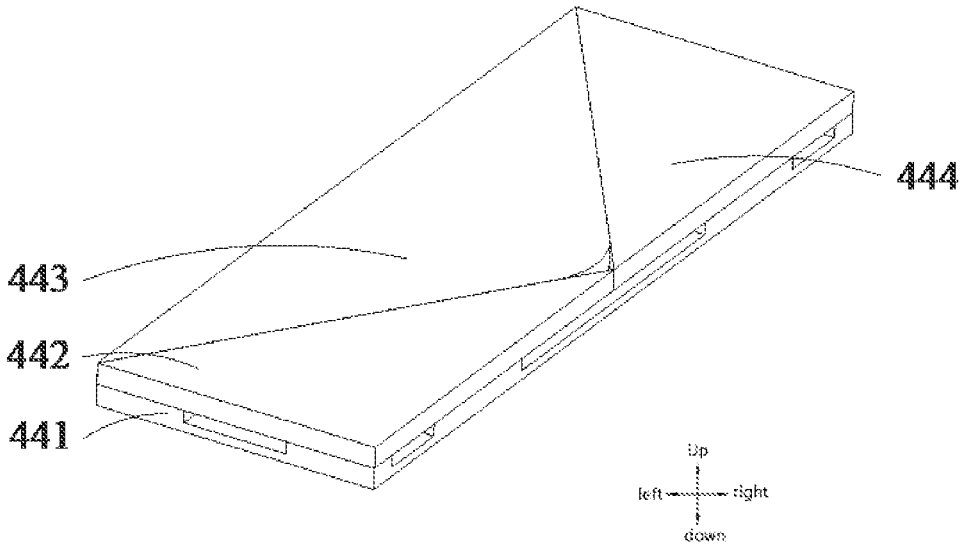
FIG. 7 is a schematic diagram of folding of the fourth module according to an embodiment of the present disclosure.

Referring to FIG. 5 and FIG. 7, both the fourth module 44 and the fifth module 45 are detachably connected to the first module 41. The fourth module 44 includes an eighth plate 441, a ninth plate 442, a tenth plate 443 and an eleventh plate 444. One end of the eighth plate 441 in the width direction is detachably connected to the first module 41, and the other end of the eighth plate 441 in the width direction is connected to the tenth plate 443. The ninth plate 443 and the eleventh plate 444 are located at two ends of the eighth plate 441 in the length direction. The ninth plate 442, the tenth plate 443 and the eleventh plate 444 can rotate 180 degrees relative to the eighth plate 441, and the ninth plate 442, the tenth plate 443 and the eleventh plate 444 are all folded toward the eighth plate 441, and the ninth plate 442, the tenth plate 443 and the eleventh plate 444 after folded are similar in size to the eighth plate 441 and are laid on the eighth plate 441. The fifth module 45 is consistent with the fourth module 44, that is, the fifth module 45 also has four plates, of which three plates can be folded onto one plate and so on. The fourth module 44 and fifth module 45 after folded can be placed in the space inside the box formed by the first module 41, which is convenient for carrying and transportation. Specifically, when the fourth module 44 is unfolded, a left end of the eighth plate 441 is connected to the first module 41, a right end of the eighth plate 441 is connected to the tenth plate 443, the ninth plate 442 is located above the eighth plate 441, and the eleventh plate 444 is located below the eighth plate 441. When the fourth module 44 is folded, the ninth plate 442, the tenth plate 443 and the eleventh plate 444 are all located above the eighth plate 441, and the ninth plate 442, the tenth plate 443 and the eleventh plate 444 are arranged side by side, and the ninth plate 442, the tenth plate 443 and the eleventh plate 444 have their projections relative to the eighth plate 441 falling within the eighth plate 441. Referring to FIG. 8, the second module 42, the third module 43, the fourth module 44 and the fifth module 45 are all in the box formed by the first module 41. The second module 42 and the third module 43 are located at a lower part inside the box, and the fourth module 44 and the fifth module 45 are located at an upper part inside the box. During transportation, the overall size of the base 4, i.e., 1.5*0.5*0.3, is the same as the size of the box formed by the first module 41, which is convenient for users to store, carry and transport.

The plates inside the second module 42, the third module 43, the fourth module 44 and the fifth module 45 can be rotatably connected or detachably connected.

Figure 9:
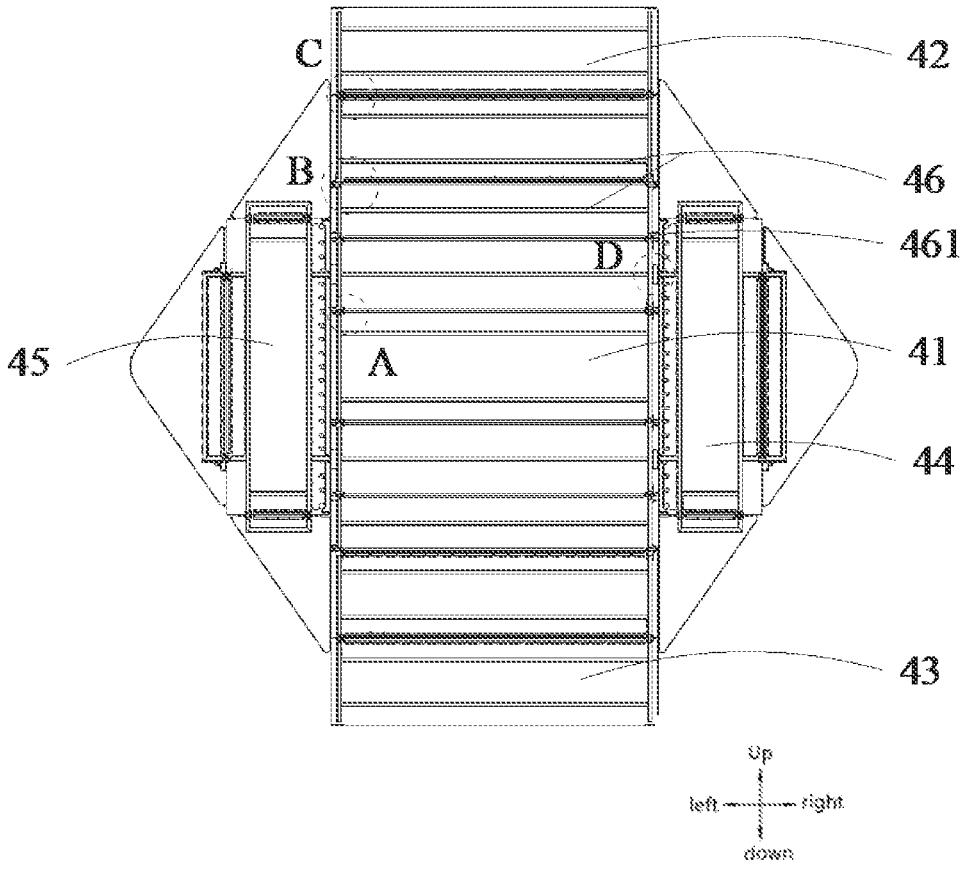
FIG. 9 is a schematic diagram of a bottom view of a base according to an embodiment of the present disclosure.

Further referring to FIG. 9, the base 4 is provided with a reinforcing member 46 for strengthening the overall structural strength of the base. Each plate of each module of the base 4 has a reinforcing member 46, and the structure of the plate can be a plastic part or a plate metal part for improving structure strength of the plates, and it can also be a reinforcing rib formed integrally with the plates and then fixed to the plates. Certainly, the plate is provided with a plurality of reinforcing rib structures, which may be holes, blind holes, or strips. Specifically, the plate is processed by blow molding process, and the base wall of the blow-molded plate has a thickness of 3 mm. In the integral molding process, holes and plastic reinforcement structures are provided on the plate to improve the structural strength of the plate; the reinforcing member 46 is fixedly connected to the plate by screws to improve the overall structural strength of the plate. A single plate has at least two reinforcing members 46. The reinforcing members 46 are aluminum alloy tubes hollow with a wall thickness of 2 mm. The hollow structure could reduce the overall mass, which is convenient for users to carry. Of course, it can also be interspersed, such as inserting the reinforcing member 46 into the plate, or other installation methods, such as clamping.

The detachable connection between the first module 41 and the second module 42 is achieved through a reinforcing member 46, and other modules are also connected through a reinforcing member 46. The plates are also connected through a reinforcing member 46. Specifically, the reinforcing member 46 of each plate is provided with an extending portion 461, which is used to connect the reinforcing member 46 between the plates. Since the reinforcing member 46 is a metal material, using the reinforcing member 46 for connecting adjacent plates enhances the strength and stability of the connection. The extending portion 461 has a through hole, and the extending portions 461 are connected by a connector 4617. The connector 4617 can be a bolt, a pin, or a bayonet. The connector 4617 is at least partially located in the through hole of the extending portion 461.

Figure 10:
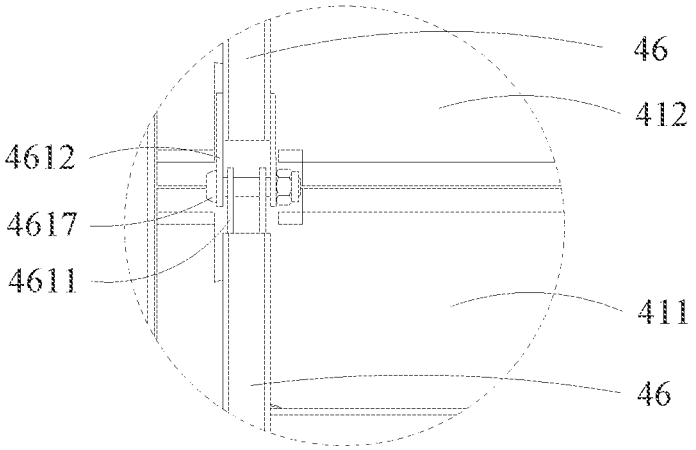
FIG. 10 is an enlarged schematic diagram of circle A in FIG. 9.

Referring to FIG. 9 and FIG. 10, the angle of rotation between the plates in the first module 41 is about 90 degrees. It can be understood that the angle of rotation between 80 degrees and 100 degrees can reach the purpose of rotation between the plates, which all fall within the protection scope of the present disclosure. Therefore, directly using a single bolt structure between the extending portions 461 of each plate can achieve fixation without affecting the 90-degree rotation between the plates, which is simple in structure and material-saving.

Specifically, the reinforcing member 461 on the first plate 411 is provided with a first extending portion 4611, the reinforcing member 461 on the second plate 412 is provided with a second extending portion 4612, and there are provided with two first extending portions 4611 and two second extending portions 4612 to reduce the possibility of relative rotation and improve the stability of the connection. The first and second extending portions are provided with through holes. The connector 4617 between the first extending portion 4611 and the second extending portion 4612 is a single bolt, which first passes through a through hole of the second extending portion 4612, then through two through holes of the first extending portion 4611, and finally through another through hole of the second extending portion 4612, thereby achieving fixation between the first extending portion 4611 and the second extending portion 4612. The first extending portion 4611 is partially located between the two second extending portions 4612.

Figure 12:
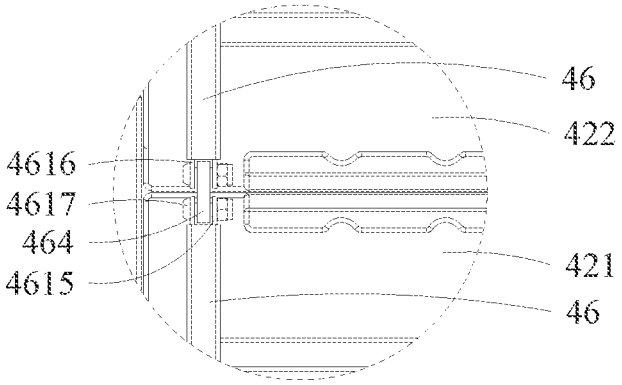
FIG. 12 is an enlarged schematic diagram of circle C in FIG. 9.

Referring to FIG. 9 and FIG. 12, the angle of rotation between each plate in the second module 42, the third module 43, the fourth module 44 and the fifth module 45 is about 180 degrees, to realize the folding of each module. It could be understood that the rotation angle may have a deviation of 10 to 15 degrees, but all that could achieve the folding purpose should fall within the protection scope of the present disclosure. At this time, only using the single bolt structure will affect the folding of the modules. Therefore, an auxiliary part 464 should be provided between the extending portions 461. One end of the auxiliary part 464 is connected to the extending portion 461 of one of the plates through bolt, and the other end of the auxiliary part 464 is connected to the extending portion 461 of another plate by bolt, so as to realize folding of adjacent plates, and then realize the respective folding of the second module 42, the third module 43, the fourth module 44 and the fifth module 45. Using the auxiliary part 464 to assist the connection improves smoothness of the folding, meets the requirements of the folding angle, and improves user experience.

Specifically, the reinforcing member 46 on the sixth plate 421 has a fifth extending portion 4615, and the reinforcing member 46 on the seventh plate 422 has a sixth extending portion 4616. There are two fifth extending portions 4615 and two sixth extending portions 4616, each of which is provided with through holes. Both ends of the auxiliary part 464 are provided with a through hole. One end of the auxiliary part 464 is located between the two fifth extending portions 4615, and the other end of the auxiliary part 464 is located between the two sixth extending portions 4616. Two bolt connectors 4617 are used between the fifth extending portions 4615 and the sixth extending portions 4616, wherein a bolt first passes through a through hole of the fifth extending portion 4615, then through the through hole of the auxiliary part 464, and through the through hole of the other fifth extending portion 4615 to achieve the rotatable connection between the auxiliary part 464 and the fifth extending portions 4615. Similarly, the rotatable connection between the auxiliary part 464 and the sixth extending portions 4616 can also be achieved.

Figure 11:
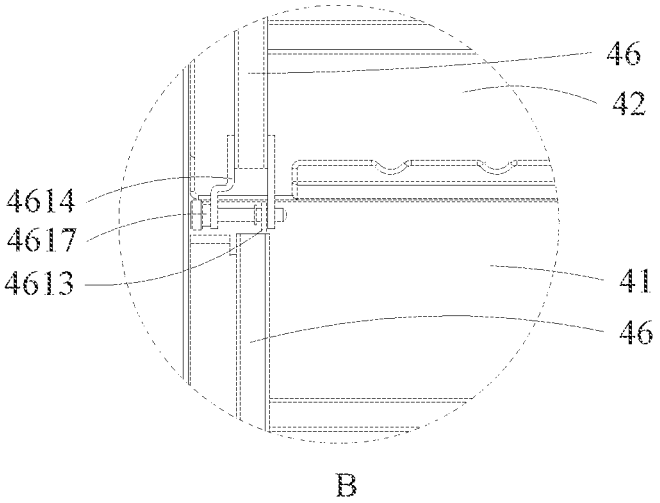
FIG. 11 is an enlarged schematic diagram of circle B in FIG. 9.

Referring to FIG. 9 and FIG. 11, the second module 42, the third module 43, the fourth module 44 and the fifth module 45 are all detachably connected to the first module 41. In order to facilitate detachment, the connection is achieved by pins or bayonets. If the second module 42 and the first module 41 are connected by pins, a pin is provided on the extending portion 461 of the reinforcing member 46 of the fourth plate 414, which pin can move along the axis of the hole of the extending portion 461. The extending portion 461 of the reinforcing member 46 of the sixth plate 421 is adapted with the extending portion 461 of the reinforcing member 46 of the fourth plate 414. When the extending portions 461 of the two plates are matched, the pins are used for fixed connection. The pins are provided with a protrusion having a diameter larger than the diameter of the hole of the extending portion 461, so as to reduce the detachment of the pin away from the extending portion 461. The pin moves axially along the hole of the extending portion 461 to open and close the extending portions 461 that are fitted to each other between the fourth plate 414 and the sixth plate 421, so as to realize the connection and detachment between the fourth plate 414 and the sixth plate 421. It can be understood that the connection mode between the third module 43 and the first module 41 is consistent with the connection mode between the second module 42 and the first module 41, which will not be repeated here.

Specifically, the fourth plate 414 of the first module 41 is detachably connected to the sixth plate 422 of the second module 42. The reinforcing member 46 on the fourth plate 414 has a third extending portion 4613, and the reinforcing member on the sixth plate 422 has a fourth extending portion 4614. There is one third extending portion 4613 and two fourth extending portions 4614. The third extending portion and the fourth extending portions all have through holes. The connector 4617 connecting the third extending portion 4613 and the fourth extending portions 4614 is a pin with a protruding structure. The pin firstly passes through a through hole of one fourth extending portion 4614, then through a through hole of the third extending portion 4613, and finally through a through hole of the other fourth extending portion 4614. One of the fourth extending portions 4614 is located between the protruding structure and the pin head, the third extending portion 4613 is located between the protruding structure and the other fourth extending portion 4614, and the other fourth extending portion 4614 and the third extending portion 4613 can be disengaged from the pin under the axial movement of the pin, thereby achieving disengagement between the third extending portion 4613 and the fourth extending portions 4614, and thus achieving detachment between the first module 41 and the second module 42.

Figure 13:
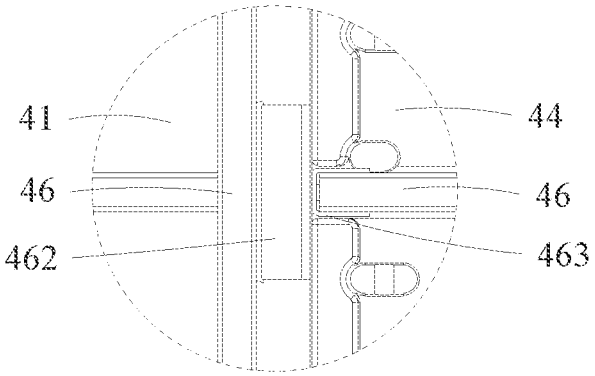
FIG. 13 is an enlarged schematic diagram of circle D in FIG. 9.
Figure 14:
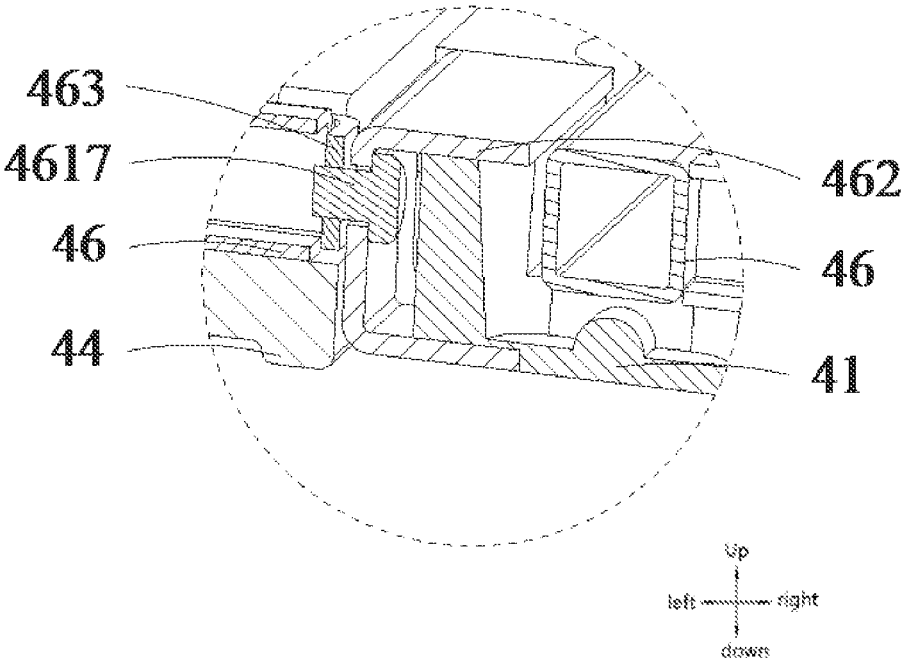
FIG. 14 is a schematic diagram of the connection structure between the first module and the second module according to an embodiment of the present disclosure.

Referring to FIG. 9, FIG. 13 and FIG. 14, the fourth module 44 and the first module 41 are connected by a connector 4617, which connector 4617 is a bayonet. The second plate 412 is provided with a first fixing plate 462, which is fixedly connected to the second plate 412 by thread. The eighth plate 441 is provided with a second fixing plate 463, which is fixed to the reinforcing member 46 on the eighth plate 441 by welding. The bayonet is fixed to the second fixing plate 463 by welding. The first fixing plate 462 has an L-shaped groove that is adapted with the bayonet. The bayonet moves up and down first and then left and right to achieve engagement, and a contrary operation would achieve disengagement. The fixation and disengagement of the second plate 412 and the eighth plate 441 are achieved by the engagement and disengagement of the bayonet and the L-shaped groove. The third plate 413 and the eighth plate 441 are connected in the same way, which improves stability of the connection. The connection mode of the fifth module 45 and the first module 41 is consistent with the connection mode between the fourth module 44 and the first module 41, which will not be repeated here.

Figure 15:
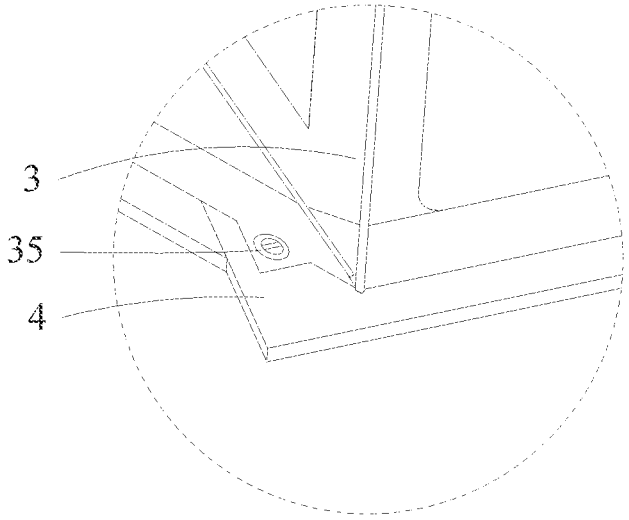
FIG. 15 is an enlarged schematic diagram of circle E in FIG. 1.
Figure 16:
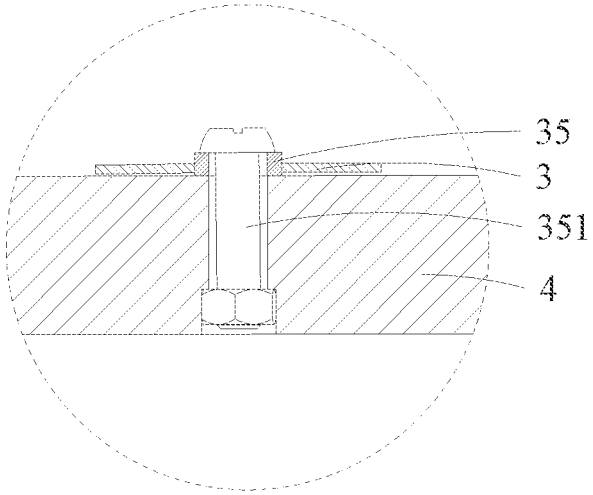
FIG. 16 is a schematic cross-sectional view of a fixing metal ring according to an embodiment of the present disclosure.

Referring to FIG. 15 and FIG. 16, the main body 1 and the base 4 are detachably fixedly connected. For example, at the joint of the main body 1 and the base 4, a metal ring piece 35 is provided on the wall 3 of the main body 1, and the metal ring piece 35 is fixedly connected to the wall 3. For example, the metal ring piece 35 is riveted to the wall 3, and such extrusion improves the stability of the connection between the metal ring piece 35 and the wall 3. The metal ring piece 35 has a hollow structure, which is used for setting the metal fixing part 351. The hollow structure is screw hole/bolt hole. The metal fixing part 351 is bolt structure. The base 4 is provided with a bolt mounting hole that is matched with the metal fixing part 351. The metal ring piece 35 is fixed on the base 4 by the metal fixing part 351, so as to realize the fixed connection between the main body 1 and the base 4. In this way, the connection stability is high, and the outdoor wind resistance is strong. There are a plurality of metal ring pieces 35, which are respectively used at the joint of the wall 3 and the base 4, and the plurality of metal ring pieces 35 one-one correspond to a plurality of metal fixing pieces 351, bolt mounting holes, etc.

Figure 18:
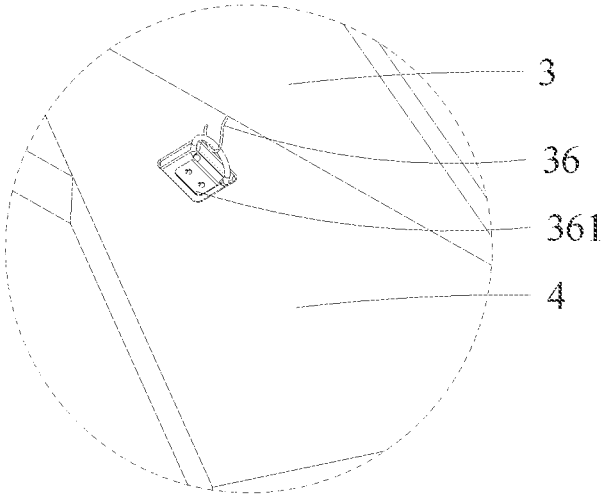
FIG. 18 is an enlarged schematic diagram of the connection between the wall and the base according to another embodiment of the present disclosure.

In some embodiments, as shown in FIG. 18, at the joint between the main body 1 and the base 4, a base snap ring 361 is fixedly provided on the base 4, and a wall hook 36 is provided on the wall 3. Fixed connection is achieved through the base snap ring 361 and the wall hook 36, which is convenient for fixing and detachment, improving the disassembly and assembly experience of users. Alternatively, the connection is achieved by Velcro, snap fasteners, etc. at the joint of the main body 1 and the base 4. Specifically, a male Velcro piece or a male snap fastener is provided on the wall 3, and a corresponding female Velcro piece or female snap fastener is provided on the base 4, which achieves detachable connection of the wall 3 and the base, thereby achieving detachable connection of the main body 1 and the base. It can be understood that the base snap ring 361 and the wall hook 36 can be used for pre-fixing first, which improves the structural connection strength between the main body 1 and the base 4, and then continues to fix the connection at the joint of the main body 1 and the base 4 by Velcro, which improves the tightness of the connection between the main body 1 and the base 4. The combination of multiple fixing methods can improve the stability and tightness of the connection between the main body 1 and the base 4, reduce the possibility of small animals entering the tent, and improves user experience.

Figure 17:
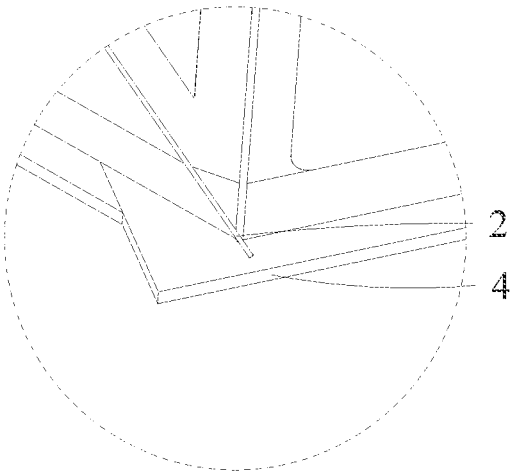
FIG. 17 is an enlarged schematic diagram of the connection between the wall and the base according to another embodiment of the present disclosure.

In other embodiments, referring to FIG. 17, the main body 1 has a frame 2 connected to the base 4. Rods of the frame 2 are inserted into and fixed to the base 4. Since the frame 2 itself has a certain structural strength, when the connection between the main body 1 and the base 4 is achieved by the frame 2, the stability of the connection is improved, thereby improving the wind resistance of the entire tent structure. It can be understood that the fixing of the main body 1 and the base 4 can also be achieved through the combination of various structures, such as the insertion of the frame 2 into the base 4, and then using the base snap ring 361 and the wall hook 36, and finally using Velcro for connection, thereby achieving the fixing of the main body 1 and the base 4.

It can be understood that the main body 1 can be made of hard materials. For example, the wall 3 is a plastic or wooden structure, and the wall 3 can be directly plugged with the base 4, or fixedly connected by connecting parts.

When the main body 1 is connected to the base 4, the main body 1 is fixed to the edges of the base 4, by which the surface area of the base 4 can be utilized to the greatest extent, thereby improving the internal space of the main body 1 and improving user experience.

The main body 1 is entirely located above the base 4, and projection of the main body 1 onto the upper surface of the base 4 is located within the upper surface of the base 4, which facilitates the installation and fixing of the main body 1. The base 4 can protect the main body 1, reducing the possibility of the main body 1 encountering the ground.

Figure 19:
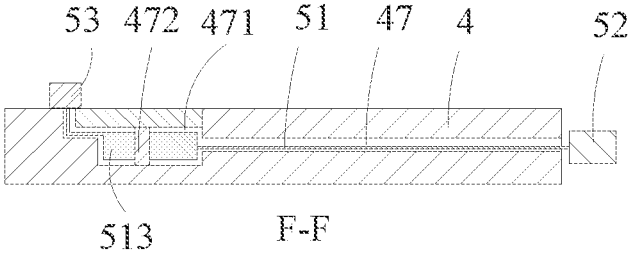
FIG. 19 is a schematic cross-sectional view along line F-F in FIG. 2.

Referring to FIG. 19, the base 4 is provided with electric wires 51, and the base 4 is provided with a wiring channel 47. Part or all of the electric wires 51 are accommodated in the wiring channel 47. The wiring channel 47 can be a through hole or a blind hole. According to the user's choice, the wiring channel 47 is made when the base 4 is integrally formed. The wiring channel 47 can prevent the electric wires 51 from being squeezed better and prolong service life of the electric wires 51. The wiring channel 47 can also be located in the groove opened on the upper surface or the lower surface of the base 4, and the electric wires 51 are arranged along the groove-shaped wiring channel 47, which is convenient for the installation and replacement of the electric wires 51. Some sealing structures are arranged at the opening of the groove to protect the electric wires and make the base 4 aesthetic in appearance, etc.

The wiring channel 47 communicates with the upper surface of the base 4, so that the electric wires 51 in the wiring channel 47 extend from the wiring channel 47 to the surface of the base, which facilitates the electrical connection of the electric wires 51 with other electrical appliances. The wiring channel 47 is located on the upper part of the base 4, which facilitates opening a channel connecting the wiring channel 47 and the upper surface of the base 4, reducing the manufacturing difficulty.

The base 4 is provided with an electric wire receiving chamber 471, in which an electric wire receiving device 513 is installed. The electric wire receiving device 513 can provide for wrapping of the electric wires 51. When the electric wire 51 is pulled, the electric wire receiving device 513 releases the electric wire 51, so that the electric wire 51 is elongated. When the electric wire 51 is not in use, the electric wire receiving device 513 could be turned to take up the electric wire. Alternatively, the electric wire receiving device 513 may also have a certain elastic force, so that when the electric wire 51 is not subjected to external pulling force, the electric wire receiving device 513 automatically takes up the electric wire. Alternatively, the electric wire receiving device 513 may also be provided with some electric devices to realize electric wire take-up, such as remote control of electric wire take-up, to improve user experience.

Specifically, the electric wire receiving device 513 is provided with an electric wire receiving post 472, and the electric wire 51 is wound around the electric wire receiving post 472. One end of the electric wire receiving post 472 is connected to the base 4, and of course it can also be connected to an electric device, or can be connected to an elastic device, etc. The other end of the electric wire receiving post 472 is connected to a cover of the electric wire receiving chamber 471, which is fixedly connected to the base 4 and can be opened to facilitate maintenance and replacement of the electric wire receiving device 513. The electric wire receiving post 472 accommodates the electric wire 51 when it rotates counterclockwise, and releases the electric wire 51 when the electric wire receiving post 472 rotates clockwise. A spring structure is arranged on the electric wire receiving post 472, and when the electric wire 51 is released and pulled, the spring on the electric wire receiving post 472 is compressed, so that the electric wire receiving post 472 has a certain force. When there is need of taking up the electric wire 51, the pulling force to the electric wire is released, and the electric wire receiving post 472 automatically takes up the electric wire under the action of the spring force of the electric wire receiving post 472. Alternatively, the electric wire receiving post 472 is provided with a motor, which is fixed on the base 4, and the motor drives the electric wire receiving post 472 to rotate to realize the storage and release of the electric wire 51, realize automation, and improve user experience.

One end of the electric wire 51 on the base 4 is provided with a socket or an electrical appliance 53, and one end is provided with a plug. A plurality of sockets can be provided, which could be located in various places in the base 4. The electric wires 51 extending out of the wiring channel 47 can be electrically connected with the sockets or electrical appliances 53 on the upper surface of the base 4. The sockets can be embedded in the base 4, and the electric wires 51 are electrically connected to the sockets in the base 4, or they can be located above the base 4, or snapped with the base 4, etc., or detachably fixedly connected on the main body 1 in such methods as snapping, sticking, Velcro or snap fasteners, etc. With the method as described above the sockets are fixed on the frame 2 and the wall 3. The plug can be connected with generator charging power supply, vehicle charging power supply, solar charging power supply, or portable power supply. The plugs are connected with different power generation or storage devices. The sockets can drive electrical appliances 53 of different powers. For example, the electrical appliance 53 can be a kettle or a lamp, and it can also be connected to a computer, etc.

Light strips are provided on the side wall or circumference of the base 4, such as ambient lights, mosquito repellent lamps, etc. An infrared induction alarm system or a weather alarm system can also be provided. Power is supplied to the light strips or the alarm system by the electric wires 51 connected with the power generation or storage devices. The light strips and the alarm system could also have their own power supply module.

In some embodiments, the main body 1 is provided with electrical appliances 53 or sockets, etc. The electric wires 51 extending out of the wiring channel 47 can be electrically connected to the sockets or electrical appliances 53 on the upper surface of the main body 1.

Although the embodiments of the present disclosure have been shown and described, those skilled in the art can understand that various changes, modifications, substitutions and variations can be made to these embodiments without departing from the principle and spirit of the present disclosure. The scope of the present disclosure is defined by the appended claims and their equivalents.

The invention claimed is:

1. An outdoor tent with a modular base, comprising a main body and a base, the main body being detachably arranged on the base, wherein the base comprises a first module and several splicing modules, said several splicing modules being detachably connected to the periphery of the first module, the first module can be folded to form a box structure, and said several splicing modules can be independently folded and stored in the box formed by the first module, wherein the base is further provided with a wiring channel and electric wires, the wiring channel communicating with an upper surface of the base, and the electric wires being arranged in the wiring channel.

2. The outdoor tent with a modular base according to claim 1, wherein the first module comprises a first plate, a second plate and a third plate, the second plate and the third plate being respectively rotatably connected to both sides of the first plate, and when the first module is folded, the second plate and the third plate are used as side walls, and the first plate is used as a bottom wall.

3. The outdoor tent with a modular base according to claim 2, wherein the first module further comprises a fourth plate and a fifth plate, the fourth plate and the fifth plate being respectively rotatably connected to outer sides of the second plate and the third plate, and when the first module is stored, the fourth plate and the fifth plate are arranged side by side opposite to the first plate, and the first module forms a box with openings on two ends.

4. The outdoor tent with a modular base according to claim 1, wherein the several splicing modules comprises a second module, a third module, a fourth module and a fifth module, wherein when the base is unfolded, the second module and the third module are located on both sides of the first module in a vertical direction, and the fourth module and the fifth module are located on both sides of the first module in a horizontal direction.

5. The outdoor tent with a modular base according to claim 4, wherein the second module comprises a sixth plate and a seventh plate, the sixth plate being rotatably connected to the seventh plate, wherein when the second module is unfolded, the sixth plate and the seventh plate are arranged side by side; when the second module is folded, the sixth plate is located above the seventh plate, and the structure of the third module is consistent with that of the second module.

6. The outdoor tent with a modular base according to claim 5, wherein the fourth module includes an eighth plate and a ninth plate, the eighth plate being rotatably connected to the ninth plate, wherein when the fourth module is unfolded, the eighth plate and the ninth plate are arranged side by side; when the fourth module is folded, the ninth plate is located above the eighth plate, and the structure of the fifth module is consistent with that of the fourth module.

7. The outdoor tent with a modular base according to claim 4, wherein joints of the second module, the third module, the fourth module, the fifth module and the first module are all connected by reinforcing members.

8. The outdoor tent with a modular base according to claim 7, wherein the first module is fixed with a first fixing plate, the fourth module is fixed with a second fixing plate, the second fixing plate being fixedly connected with the reinforcing member of the fourth module, the first fixing plate being detachably connected to the second fixing plate, and the first fixing plate being provided with an L-shaped groove matching with the second fixing plate.

9. The outdoor tent with a modular base according to claim 1, wherein the wiring channel is located on the upper part of the base, the electric wires can extend from the wiring channel to the upper surface of the base, and the base is provided with electrical appliances or sockets, the electric wires extending out of the wiring channel being electrically connected to the electrical appliances or the sockets, and an electric wire receiving chamber is further provided in the base, in which an electric wire receiving post is provided in the electric wire receiving chamber, the electric wire receiving chamber being connected to the wiring channel, and the electric wires being arranged around the electric wire receiving post.

* * * * *